US011454049B2

(12) United States Patent
Elsmark

(10) Patent No.: US 11,454,049 B2
(45) Date of Patent: Sep. 27, 2022

(54) ACTUATOR COMPRISING ELECTRO PERMANENT MAGNET AND METHOD

(71) Applicant: ASSA ABLOY AB, Stockholm (SE)

(72) Inventor: Lars Elsmark, Saltsjö-Boo (SE)

(73) Assignee: ASSA ABLOY AB, Stockholm (SE)

( * ) Notice: Subject to any disclaimer, the term of this patent is extended or adjusted under 35 U.S.C. 154(b) by 273 days.

(21) Appl. No.: 16/955,277

(22) PCT Filed: Dec. 5, 2018

(86) PCT No.: PCT/EP2018/083591
§ 371 (c)(1),
(2) Date: Jun. 18, 2020

(87) PCT Pub. No.: WO2019/121000
PCT Pub. Date: Jun. 27, 2019

(65) Prior Publication Data

US 2020/0392758 A1 Dec. 17, 2020

(30) Foreign Application Priority Data

Dec. 19, 2017 (SE) ..... 1751574-3

(51) Int. Cl.
*H01F 7/16* (2006.01)
*E05B 47/00* (2006.01)
(Continued)

(52) U.S. Cl.
CPC ..... *E05B 47/0038* (2013.01); *H01F 7/0226* (2013.01); *H01F 7/064* (2013.01);
(Continued)

(58) Field of Classification Search
CPC ..... E05B 47/0038; E05B 2047/0076; E05Y 2201/462; H01F 7/0226; H01F 7/081; H01F 2007/086; H01F 7/1615; H01F 2007/1669
See application file for complete search history.

(56) References Cited

U.S. PATENT DOCUMENTS 4,306,207 A 12/1981 Tada et al.
5,677,821 A 10/1997 Myr
(Continued)

FOREIGN PATENT DOCUMENTS

CN 1623211 6/2005
CN 101572159 11/2009
(Continued)

OTHER PUBLICATIONS

Official Action with English Translation for China Patent Application No. 201880081604.X, dated May 25, 2021, 13 pages.
(Continued)

*Primary Examiner* — Ramon M Barrera
(74) *Attorney, Agent, or Firm* — Sheridan Ross P.C.

(57) ABSTRACT

Actuator (10) comprising a base section (14,14*a*,14*b*); a permanent magnet (18,18*a*,18*b*); an electro permanent magnet (20, 20*a*, 20*b*); a coil (22, 22*a*, 22*b*) located around the electro permanent magnet (20, 20*a*, 20*b*); a power controller (24, 24*a*, 24*b*); and a movable member (28) comprising at least one magnetic target section (36), the movable member (28) being arranged to move to a first position (12) relative to the base section (14,14*a*,14*b*), when the electro permanent magnet (20, 20*a*, 20*b*) adopts a first polarity, and arranged to move to a second position (46) relative to the base section (14,14*a*,14*b*) due to a magnetic field generated by the permanent magnet (18,18*a*,18*b*) and the electro permanent magnet (20, 20*a*, 20*b*) in combination and acting on the magnetic target section (36), when the electro permanent
(Continued)

magnet (20, 20*a*, 20*b*) adopts a second polarity. A lock device (50), a handle device (86) and a method are also provided.

15 Claims, 8 Drawing Sheets

(51) Int. Cl.
*H01F 7/02* (2006.01)
*H01F 7/06* (2006.01)
*H01F 7/08* (2006.01)

(52) U.S. Cl.
CPC ..... *H01F 7/081* (2013.01); *H01F 7/1623* (2013.01); *E05B 2047/0076* (2013.01); *E05Y 2201/462* (2013.01); *E05Y 2900/132* (2013.01); *H01F 2007/086* (2013.01); *H01F 2007/1669* (2013.01)

(56) References Cited

U.S. PATENT DOCUMENTS

| | | | |
|---|---|---|---|
| 2010/0289359 | A1 | 11/2010 | Knaian et al. |
| 2012/0299315 | A1 | 11/2012 | Chen |

FOREIGN PATENT DOCUMENTS

| | | |
|---|---|---|
| CN | 103038433 | 4/2013 |
| CN | 104126268 | 10/2014 |
| CN | 105804828 | 7/2016 |
| DE | 19639545 | 12/1997 |
| EP | 0715179 | 6/1996 |
| EP | 2284340 | 2/2011 |
| EP | 2793243 | 10/2014 |
| WO | WO 2011/160188 | 12/2011 |
| WO | WO 2016/075571 | 5/2016 |
| WO | WO 2017/033030 | 3/2017 |

OTHER PUBLICATIONS

Abeywardana et al. "Electropermanent Magnet Based Wireless Microactuator for Microfluidic Systems: Actuator control and energy consumption aspects," 2016 IEEE Sensors, IEEE, Oct. 30, 2016, 3 pages.

Kularatna-Abeywardana et al. "Preliminary Development of an Ultra Low Power Electro-permanent Magnet Based Actuator for Microfluidic Systems," 2015 IEEE 10th Conference on Industrial Electronics and Applications (ICIEA, 2015, pp. 1741-1746.

International Search Report and Written Opinion for International (PCT) Patent Application No. PCT/EP2018/083591, dated Mar. 28, 2019, 15 pages.

Official Action for European Patent Application No. 18819021.9, dated Feb. 16, 2022, 5 pages.

ACTUATOR COMPRISING ELECTRO PERMANENT MAGNET AND METHOD

CROSS REFERENCE TO RELATED APPLICATIONS

This application is a national stage application under 35 U.S.C. 371 and claims the benefit of PCT Application No. PCT/EP2018/083591 having an international filing date of Dec. 5, 2018, which designated the United States, which PCT application claimed the benefit of Sweden Patent Application No. 1751574-3 filed Dec. 19, 2017, the disclosure of each of which are incorporated herein by reference.

TECHNICAL FIELD

The present disclosure generally relates to actuators comprising an electro permanent magnet. In particular, an actuator comprising an electro permanent magnet and a movable member arranged to move between a first position and a second position, lock devices comprising the actuator, a handle device comprising the actuator and a method for operating the actuator, are provided.

BACKGROUND

Various types of actuators may be used in lock devices. One type of powered actuator is a motor that rotates a drive shaft, which requires power to both lock and unlock a lock device, for example an electric strike. Another type of powered actuator is a solenoid which has a plunger that moves relative to a housing in response to power being supplied. Such solenoids are typically provided with a spring to return the plunger to its original position without power. The solenoid includes a coil and a shaft which is axially movable within the coil. The coil is energized by connection to a source of electrical current and thereby generates magnetic flux which influences the shaft to move in one direction. When the coil is de-energized, the spring operates to move the shaft in the reverse direction. One advantage with solenoids over motors is that in a power failure event, the plunger can still return to its original position.

US 2012299315 A1 discloses a structure for electrical locks comprising two rotational members, a latching assembly and a controlling means. The two rotational members are respectively secured to two handles of a door. The latching assembly includes a cartridge, a sliding element and a dividing rod. The dividing rod is fitted in the cartridge to define two lateral zones respectively corresponding to two recesses of the rotational members. The sliding member is slidably fitted in one of the lateral zones of the cartridge. The controlling means includes a pushing assembly and a solenoid. When the solenoid is de-energized, the pushing assembly can be moved forward to lock a respective handle. When the solenoid is energized, the pushing assembly can be moved back to free the respective handle.

SUMMARY

One object of the present disclosure is to provide an actuator having a low power consumption.

A further object of the present disclosure is to provide an actuator having a small size.

A still further object of the present disclosure is to provide an actuator having a reliable operation.

A still further object of the present disclosure is to provide an actuator having a simple design.

A still further object of the present disclosure is to provide an actuator having a good protection against tampering.

A still further object of the present disclosure is to provide an actuator that is efficient, i.e. has a high magnetic holding force relative to its size.

A still further object of the present disclosure is to provide an actuator solving two or more of the foregoing objects.

A still further object of the present disclosure is to provide a lock device comprising an actuator solving one, several or all of the foregoing objects.

A still further object of the present disclosure is to provide a handle device comprising an actuator solving one, several or all of the foregoing objects. A still further object of the present disclosure is to provide a method for operating an actuator solving one, several or all of the foregoing objects.

According to one aspect, there is provided an actuator comprising at least one base section; at least one permanent magnet arranged in the base section; at least one electro permanent magnet arranged in the base section, the at least one electro permanent magnet being configured to switch a polarity between a first polarity and a second polarity when being subjected to a magnetic field and configured to maintain the polarity when the magnetic field is removed; a coil located around the electro permanent magnet; a power controller configured to apply a current pulse to the coil to generate the magnetic field for changing the polarization of the electro permanent magnet; and a movable member comprising at least one magnetic target section, the movable member being arranged to move to a first position relative to the base section, when the electro permanent magnet adopts the first polarity, and arranged to move to a second position relative to the base section due to a magnetic field generated by the permanent magnet and the electro permanent magnet in combination and acting on the magnetic target section, when the electro permanent magnet adopts the second polarity.

When a current pulse of a certain duration and level is applied to the coil wound around the electro permanent magnet, the magnetic field generated by the current pulse flips the polarity of the electro permanent magnet. Once the electro permanent magnet has been flipped from the first polarity to the second polarity, the permanent magnet and the electro permanent magnet combine to generate an electric field. This electric field acts on the magnetic target section of the movable member (e.g. by means of an attractive or repulsive force) such that the movable member moves from the first position to the second position. Once the polarity of the electro permanent magnet has been switched from the first polarity to the second polarity and the movable member has moved from the first position to the second position, the electric field generated by the permanent magnet and the electro permanent magnet in combination may hold the movable member in the second position without power supply. The first position and the second position may constitute distinct positions for the movable member.

Throughout the present disclosure, the base section may be constituted by a stationary structure. According to one variant, the actuator comprises two pole pieces, one permanent magnet and one electro permanent magnet arranged between the two pole pieces. In this case, the base section may be constituted by the permanent magnet, the electro permanent magnet and the two pole pieces. The base section may however comprise further components. The movable member may comprise an elongated portion and a head portion and the magnetic target section may be constituted by, or arranged in, the head portion.

The at least one electro permanent magnet may be hollow, e.g. cylindrical or substantially cylindrical. In this case, the movable member may be arranged to move within the electro permanent magnet. Also the at least one permanent magnet and/or the pole pieces may be hollow. According to one example, the base section comprises an outer cylindrical electro permanent magnet, an inner cylindrical permanent magnet and two circular pole pieces attached to the respective ends of the electro permanent magnet and the permanent magnet. In this case, the coil may be wound around the electro permanent magnet and the movable member may be guided within the electro permanent magnet, the permanent magnet, the pole pieces and the coil. The base section may thus be generally cylindrical and may have an outer diameter of only a few millimeters, such as maximum 5 millimeters.

The actuator according to the present disclosure may be referred to as a low power actuator. The actuator may for example be constituted by an actuator for a lock device, such as a lock cylinder, a lock case or a strike assembly, or for a handle device for operating doors, windows and the like. Other implementations are conceivable.

The electro permanent magnet has lower coercivity than the permanent magnet. Throughout the present disclosure, the electro permanent magnet may alternatively be referred to as a switching magnet or soft magnet and the permanent magnet may alternatively be referred to as a hard magnet. The magnetically hard material may for example comprise a Neodymium alloy such as a Neodymium-Iron-Boron (NdFeB), or other alloy having a relatively high intrinsic coercivity. The magnetically soft material may for example comprise an Alnico alloy, Iron-Cobalt-Vanadium, or other alloy having a relatively low intrinsic coercivity. The permanent magnet and the electro permanent magnet may collectively be referred to as a dual material permanent magnet.

When the electro permanent magnet adopts the second polarity, the movable member may be arranged to move to the second position due to either an attractive magnetic force or a repulsive magnetic force. The actuator may further comprise at least one resetting element configured to move the movable member to the first position when the electro permanent magnet adopts the first polarity. Alternatively, or in addition, the movable member may be forced towards the first position or towards the second position by means of gravity.

The resetting element may be constituted by an elastic element. In this case, the actuator may be configured such that the magnetic field, generated by the permanent magnet and the electro permanent magnet in combination and acting on the magnetic target section when the electro permanent magnet adopts the second polarity, moves the movable member to the second position and deforms the elastic element. The deformation of the elastic element may be either a compression or an extension. For example, the elastic element may be compressed a smaller amount when the movable member adopts the first position and may be compressed a larger amount when the movable member adopts the second position. Alternatively, the elastic element may be extended a smaller amount when the movable member adopts the first position and may be extended a larger amount when the movable member adopts the second position.

The elastic element may be fixed to the base section, or to a section fixed with respect to the base section, and to the movable member, or to a section fixed with respect to the movable member. The elastic element may for example be constituted by a spring, such as a coil spring, or by a rubber component.

According to one variant, the at least one base section is constituted by a first base section and a second base section; the at least one permanent magnet is constituted by a first permanent magnet and a second permanent magnet; and the at least one electro permanent magnet is constituted by a first electro permanent magnet arranged in the first base section and a second electro permanent magnet arranged in the second base section. In this case, the movable member may be arranged to move to the first position relative to the first base section and the second base section, when the first electro permanent magnet adopts the first polarity, and arranged to move to the second position relative to the first base section and the second base section due to a magnetic field generated by the first permanent magnet and the first electro permanent magnet in combination and acting on the magnetic target section, when the first electro permanent magnet adopts the second polarity. The first base section and the second base section may be fixedly connected to each other, for example by means of a connecting member.

The actuator according to this variant may comprise two elastic elements. A first elastic element may be configured to force the movable member to the first position and a second elastic element may be configured to force the movable member to the second position. For example, when the movable member moves to the first position, the first elastic element may be compressed a smaller amount and the second elastic element may be compressed a larger amount and when the movable member moves to the second position, the first elastic element may be compressed a larger amount and the second elastic element may be compressed a smaller amount. A reverse configuration (i.e. by using extension forces of the elastic elements) is also possible. The two elastic elements thus provide a balancing effect on the movable member and thus facilitates the movement of the movable member between the first position and the second position.

The first elastic element may be fixed to the first base section, or to a section fixed with respect to the first base section, and to the movable member, or to a section fixed with respect to the movable member. The second elastic element may be fixed to the second base section, or to a section fixed with respect to the second base section, and to the movable member, or to a section fixed with respect to the movable member. Each elastic element may for example be constituted by a spring, such as a coil spring, or by a rubber component.

According to an alternative example, the actuator according to this variant does not comprise any elastic element for moving the movable member. In this case, the movable member may move from the first position to the second position only due to the magnetic field generated by the first permanent magnet and the first electro permanent magnet in combination with the first electro permanent magnet adopts the second polarity.

Furthermore, in this variant, the second electro permanent magnet may be switched from the second polarity to the first polarity at the same time, or at substantially the same time, as the first electro permanent magnet is switched from the first polarity to the second polarity.

The first base section may for example comprise two first pole pieces and the first permanent magnet and the first electro permanent magnet may be arranged between the two first pole pieces. The second base section may for example comprise two second pole pieces and the second permanent magnet and the second electro permanent magnet may be arranged between the two pole pieces. In this case, the first base section may be constituted by the first permanent magnet, the first electro permanent magnet and the two first pole pieces and the second base section may be constituted by the second permanent magnet, the second electro permanent magnet and the two second pole pieces.

Each of the first electro permanent magnet and the second electro permanent magnet may be hollow, e.g. cylindrical or substantially cylindrical. In this case, the movable member may be arranged to move within each of the first electro permanent magnet and the second electro permanent magnet. Also the first permanent magnet, the second permanent magnet and/or the pole pieces may be hollow. According to one example, each of the first base section and the second base section comprises an outer cylindrical electro permanent magnet, an inner cylindrical permanent magnet and two circular pole pieces attached to the respective ends of the electro permanent magnet and the permanent magnet. In this case, a first coil may be wound around the first electro permanent magnet, a second coil may be wound around the second electro permanent magnet and the movable member may be guided within the first electro permanent magnet, the first permanent magnet, the first pole pieces, the second electro permanent magnet, the second permanent magnet, the second pole pieces, the first coil and the second coil. Each of the first base section and the second base section may thus be generally cylindrical.

The movable member may be arranged to move to the first position relative to the first base section and the second base section due to a magnetic field generated by the second permanent magnet and the second electro permanent magnet in combination and acting on the magnetic target section.

Also in this variant, the actuator may comprise the two elastic elements as described above. Alternatively, the actuator does not need to comprise any elastic element for moving the movable member. In this case, the movable member may move from the second position to the first position only due to the magnetic field generated by the second permanent magnet and the second electro permanent magnet in combination when the second electro permanent magnet adopts the second polarity.

Furthermore, in this variant, the first electro permanent magnet may be switched from the second polarity to the first polarity at the same time, or at substantially the same time, as the second electro permanent magnet is switched from the first polarity to the second polarity.

The actuator may further comprise a first mechanical stop defining the first position of the movable member relative to the base section. The first mechanical stop may for example be constituted by a protrusion, such as a collar, on the elongated portion of the movable member, that engages with the base section. Alternatively, the first mechanical stop may be constituted by a profile, such as an inclined surface, on the head portion of the movable member, that engages with the base section.

The actuator may further comprise a second mechanical stop defining the second position of the movable member relative to the base section. The second mechanical stop may also be constituted by a profile, such as an inclined surface, on the head portion of the movable member, that engages with the base section. Alternatively, the second mechanical stop may also be constituted by a protrusion, such as a collar, on the elongated portion of the movable member, that engages with the base section.

The movable member may be arranged to move substantially linearly, or linearly, relative to the base section between the first position and the second position. Other movement paths of the movable member, including for example curved movement paths, are conceivable.

A magnetic field outside the base section may be substantially neutral, or neutral, when the electro permanent magnet adopts the first polarity. In the variant comprising a first electro permanent magnet arranged in a first base section and a second electro permanent magnet arranged in a second base section, the magnetic field outside the first base section may be substantially neutral when the first electro permanent magnet adopts the first polarity and the magnetic field outside the second base section may be substantially neutral when the second electro permanent magnet adopts the first polarity.

The permanent magnet and the electro permanent magnet may be polarized in the same direction when the electro permanent magnet adopts the second polarity. The actuator may further comprise a battery for powering the power controller. An external power supply may alternatively be employed for supplying electrical power to the power controller. In case the actuator comprises a first electro permanent magnet arranged in a first base section and a second electro permanent magnet arranged in a second base section, one power controller may be associated with each electro permanent magnet or one common power controller may be used in common.

According to a further aspect, there is provided a lock device comprising an actuator according to the present disclosure. When the actuator is used with a locking device, the actuator may constitute a blocking mechanism of the locking device. The actuator according to the present disclosure may replace many blocking mechanisms in conventional lock devices, for example blocking mechanisms driven by a solenoid, a motor or a voice coil.

According to one variant, the lock device is constituted by a lock cylinder. In this case, the lock cylinder may comprise a stationary structure and a cylinder core rotatably accommodated in the stationary structure, wherein the first position of the movable member constitutes a disconnecting position in which the cylinder core is allowed to rotate relative to the stationary structure, and wherein the second position of the movable member constitutes an interconnecting position in which the movable member engages both the cylinder core and the stationary structure such that the cylinder core is prevented from rotating relative to the stationary structure.

According to a further variant, the lock device is constituted by a lock case. In this case, the lock case may comprise a follower unit having a hub and a coupling device, wherein coupling device is movable under control of the actuator between an engaging position where two parts of the hub are engaged and a disengaging position where the two parts of the hub are disengaged.

According to a further aspect, there is provided a handle device for operating doors, windows and the like, comprising an actuator according to the present disclosure. In addition to the actuator, the handle device may comprise a first element rotatable about an axis, a second element rotatable about the axis, a coupling device movable under control of the actuator between an engaging position where the first element and the second element are engaged and a disengaging position where the first element and the second element are disengaged. The first element may be constituted by a handle grip or a boss and the second element may be constituted by a handle escutcheon or a cylindrical end section.

According to a further aspect, there is provided a method for operating an actuator comprising at least one base section, at least one permanent magnet arranged in the base section, at least one electro permanent magnet arranged in the base section, and a movable member comprising at least one magnetic target section, the method comprising providing the electro permanent magnet with a first polarity such that a magnetic field outside the base section is substantially neutral; switching the polarity of the electro permanent magnet from the first polarity to a second polarity such that the permanent magnet and the electro permanent magnet combine to generate a magnetic field acting on the magnetic target section such that the movable member moves from a first position relative to the base section to a second position relative to the base section. The actuator for the method may be of any type according to the present disclosure.

In case the method is used with an actuator comprising a first permanent magnet and a first electro permanent magnet arranged in a first base section and a second permanent magnet and a second electro permanent magnet arranged in a second base section, the method may further comprise providing the first electro permanent magnet with a first polarity such that a magnetic field outside the first base section is substantially neutral; switching the polarity of the first electro permanent magnet from the first polarity to a second polarity such that the first permanent magnet and the first electro permanent magnet combine to generate a magnetic field acting on the magnetic target section and such that the movable member moves from a first position relative to the first base section and the second base section to a second position relative to the first base section and the second base section. The method may further comprise switching the second electro permanent magnet from a second polarity to a first polarity, at substantially the same time as the first electro permanent magnet is switched from the first polarity to the second polarity, such that a magnetic field outside the second base section is substantially neutral.

The method may further comprise switching the polarity of the second electro permanent magnet from the first polarity to the second polarity such that the second permanent magnet and the second electro permanent magnet combine to generate a magnetic field acting on the magnetic target section and such that the movable member moves from the second position relative to the first base section and the second base section to the first position relative to the first base section and the second base section. The method may further comprise switching the first electro permanent magnet from the second polarity to the first polarity, at substantially the same time as the second electro permanent magnet is switched from the first polarity to the second polarity, such that a magnetic field outside the first base section is substantially neutral.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1A:
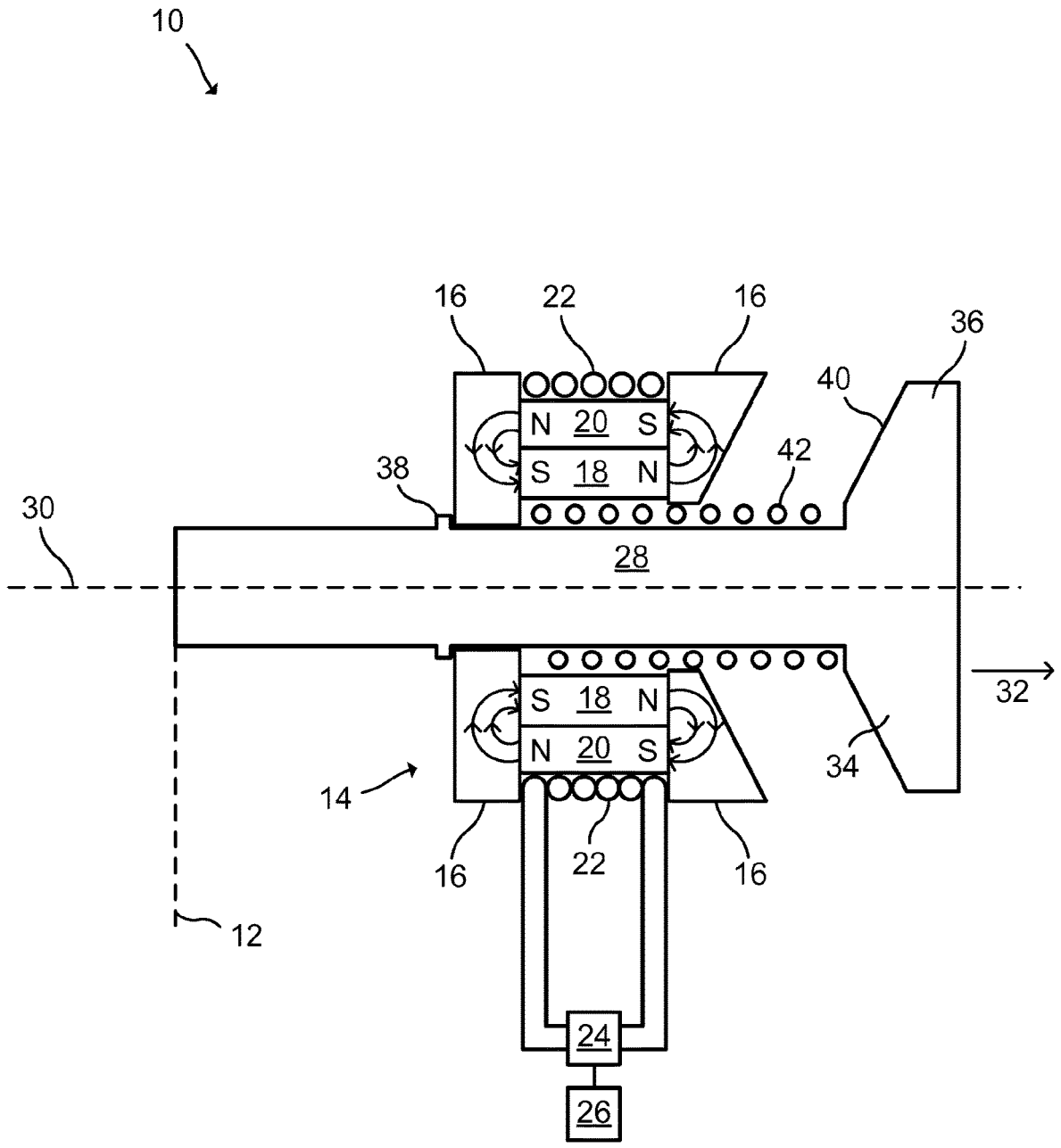
FIG. 1*a*: schematically represents a side view of an actuator in a first position.

In the following, an actuator comprising an electro permanent magnet and a movable member arranged to move between a first position and a second position, lock devices comprising the actuator, a handle device comprising the actuator and a method for operating the actuator, will be described. The same reference numerals will be used to denote the same or similar structural features.

FIG. 1*a* schematically represents a side view of an actuator 10. In FIG. 1*a*, the actuator 10 is in a first position 12. The actuator 10 comprises a base section 14. The base section 14 comprises two pole pieces 16, a permanent magnet 18 and an electro permanent magnet 20. The permanent magnet 18 and the electro permanent magnet 20 are arranged between the two pole pieces 16. As shown in FIG. 1*a*, the electro permanent magnet 20 is hollow. Also the permanent magnet 18 is hollow.

The permanent magnet 18 may for example comprise a Neodymium alloy and the electro permanent magnet 20 may for example comprise an Alnico alloy. In FIG. 1*a*, the permanent magnet 18 and the electro permanent magnet 20 have opposite polarities such that a magnetic field outside the base section 14 is substantially neutral.

The pole pieces 16 may for example be made of relay steel, such as Hiperco® alloy. At least the right pole piece 16 may have a smooth exterior surface to minimize air gaps.

A coil 22 is wound around the permanent magnet 18 and the electro permanent magnet 20. The number of windings of the coil 22 may vary. The coil 22 may comprise copper wirings.

The actuator 10 further comprises a power controller 24. The power controller 24 is in this example powered by a battery 26. The power controller 24 is configured to apply current pulses to the coil 22 such that magnetic fields are generated. The power controller 24 may comprise switches, a pulse control transistor and a flyback diode for protecting the pulse control transistor. The battery 26 may provide a high power voltage supply (e.g. maximum 60V and maximum 20 A). Alternatively, the power controller 24 may be connected to a charged capacitor optimized for the specific pulse for the electro permanent magnet 20.

The actuator 10 further comprises a movable member 28. The movable member 28 of this example is arranged to move linearly along a movement axis 30. In FIG. 1*a*, the movable member 28 has moved in a first direction 32 along the movement axis 30 to the illustrated first position 12.

In this example, the pole pieces 16, the permanent magnet 18, the electro permanent magnet 20 and thus the entire base section 14 are cylindrical. The movable member 28 is guided within the cylindrical base section 14.

The movable member 28 comprises an elongated portion and a head portion 34. The head portion 34 comprises a magnetic target section 36 of a material strongly responsive to magnetic fields. The movable member 28 further comprises a first mechanical stop 38, here implemented as a collar on the elongated portion and a second mechanical stop 40, here constituted by an inclined surface on the head portion 34.

The actuator 10 further comprises a resetting element 42. In this example, the resetting element 42 is constituted by an elastic element in the form of a spring connected between the base section 14 and the movable member 28 and encircling the movable member 28. The resetting element 42 pushes the movable member 28 in the first direction 32 such that the first mechanical stop 38 engages the base section 14, more specifically the left pole piece 16 of the base section 14.

By applying a current pulse to the coil 22 of sufficient duration and level, a magnetic field is generated that switches the polarity of the electro permanent magnet 20 from a first polarity to a second polarity but that does not switch the polarity of the permanent magnet 18, which has a higher coercivity. The thresholds of the magnetic fields where the electro permanent magnet 20 is flipped/switches polarity and where the permanent magnet 18 is flipped, depends on the coercivity of the respective material.

The applied current pulse may for example have a duration of between 30 μs to 750 μs, such as between 50 μs to 450 μs, such as between 75 μs to 300 μs, such as 100 μs to 200 μs, such as 150 μs. Several current pulses may for example be spaced 10 ms in time. The power supply voltage may for example be 10 V to 40 V, such as 20 V to 30 V.

Figure 1B:
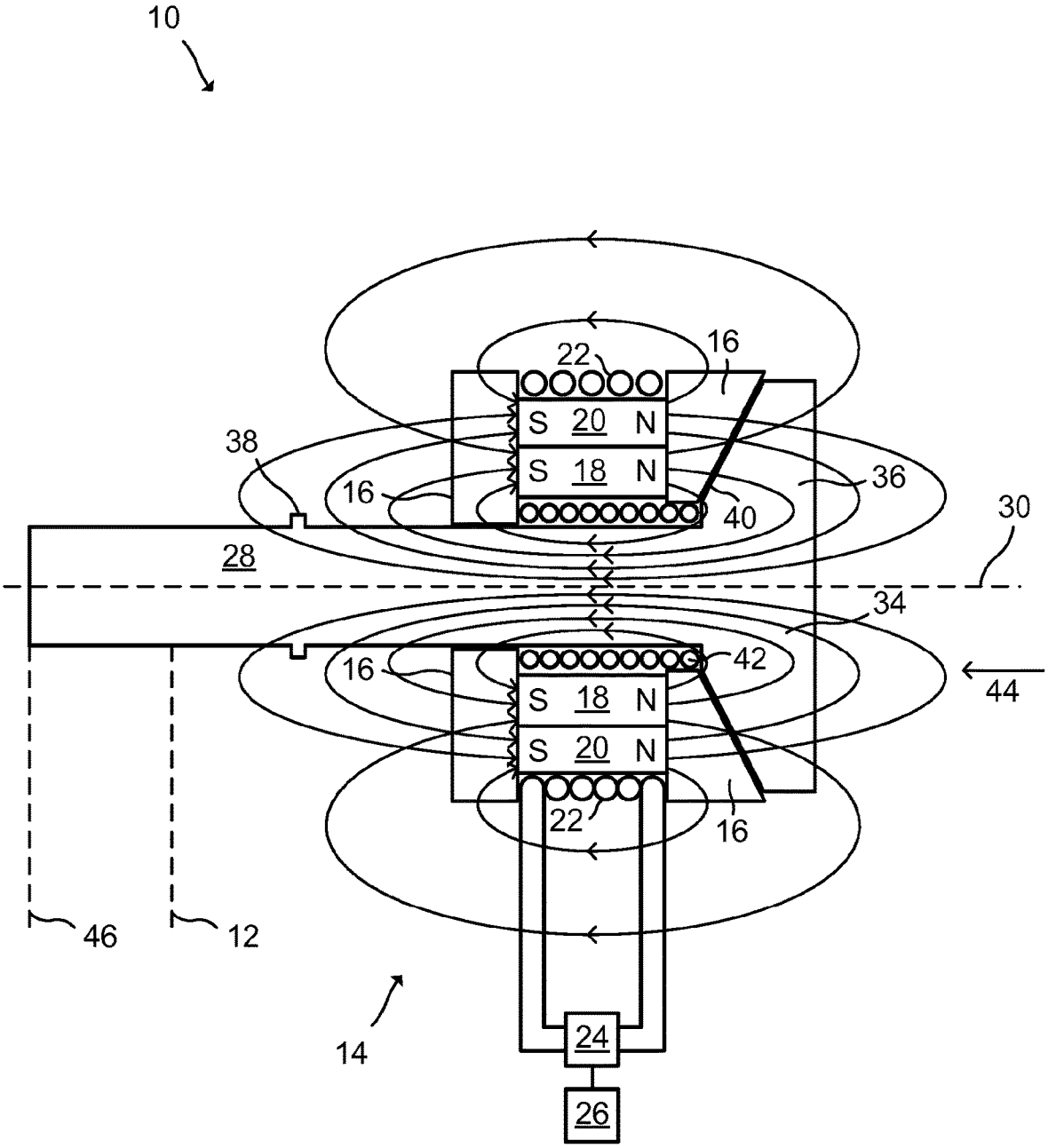
FIG. 1*b*: schematically represents a side view of the actuator in FIG. 1*a* in a second position.

FIG. 1*b* schematically represents a side view of the actuator 10 in FIG. 1*a*. As illustrated in FIG. 1*b*, when the electro permanent magnet 20 has been flipped from the first polarity in FIG. 1*a* to the second polarity in FIG. 1*b*, the permanent magnet 18 and the electro permanent magnet 20 combine to generate a magnetic field outside the base section 14. This magnetic field acts on the magnetic target section 36 and pulls the movable member 28 in a second direction 44 linearly along the movement axis 30 to a second position 46. The movable member 28 moves within the electro permanent magnet 20. At the same time, the resetting element 42 is further compressed until the second mechanical stop 40 contacts the right pole piece 16 of the base section 14. The movable member 28 is maintained in the second position 46 due to the magnetic force generated by the permanent magnet 18 and the electro permanent magnet 20 in combination until the polarity of the electro permanent magnet 20 is switched again. The right surface of the right pole piece 16 is also inclined such that a tight mating is provided between the second mechanical stop 40 and the base section 14.

Since electric power is supplied only for a short time when flipping the polarity of the electro permanent magnet 20, it is possible to save energy while ensuring safety and reliability. In addition, since electric power is supplied only when flipping the polarity of the electro permanent magnet 20, there is no temperature rise. This prevents heat from being generated from the actuator 10.

By applying a current pulse in the coil 22 of sufficient duration and level in a reverse direction, the polarity of the electro permanent magnet 20 can be switched from the second polarity to the first polarity. As a consequence, the magnetic field outside the base section 14 is again substantially neutral and the resetting element 42 pushes the movable member 28 in the first direction 32 back to the first position 12 in FIG. 1*a* where the first mechanical stop 38 contacts the base section 14.

Figure 2A:
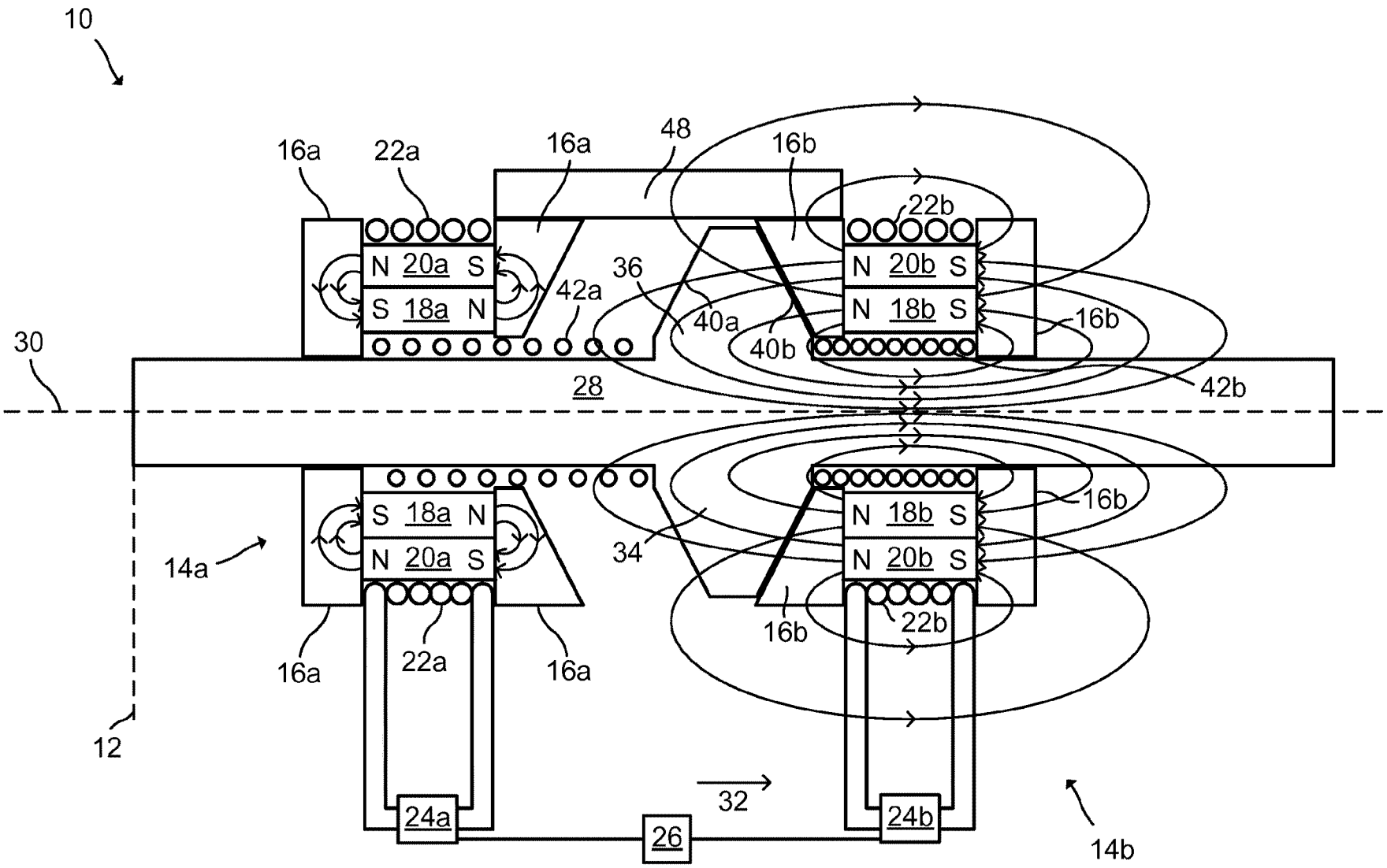
FIG. 2*a*: schematically represents a side view of a further actuator in a first position.

FIG. 2*a* schematically represents a side view of a further actuator 10. Mainly differences with respect to FIGS. 1*a* and 113 will be described. In FIG. 2*a*, the actuator 10 is in a first position 12.

The actuator 10 in FIG. 2*a* comprises a first base section 14*a* and a second base section 14*b*. The first base section 14*a* and the second base section 14*b* are fixed relative to each other. In the example in FIG. 2*a*, the first base section 14*a* and the second base section 14*b* are connected by means of a connecting member 48.

The first base section 14*a* comprises two first pole pieces 16*a*, a first permanent magnet 18*a* and a first electro permanent magnet 20*a* and the second base section 14*b* comprises two second pole pieces 16*b*, a second permanent magnet IA and a second electro permanent magnet 20*b*. The first permanent magnet 18*a* and the first electro permanent magnet 20*a* are arranged between the two first pole pieces 16*a* and the second permanent magnet 1813 and the second electro permanent magnet 20*b* are arranged between the two second pole pieces 16*b*. In this example, each of the first base section 14*a* and the second base section 14*b* is cylindrical. As shown in FIG. 2*a*, each of the electro permanent magnets 20*a*, 20*b* is hollow. Also each of the permanent magnets 18*a*, 18*g* is hollow.

The movable member 28 in FIG. 2*a* comprises a two elongated portions and a head portion 34 therebetween. Similar to FIGS. 1*a* and 1*b*, the head portion 34 comprises the magnetic target section 36.

The movable member 28 in FIG. 2*a* comprises a first mechanical stop 40*a* and a second mechanical stop 40*b*. In this example, each of the first mechanical stop 40*a* and the second mechanical stop 40*b* is constituted by an inclined surface on the head portion 34.

A first coil 22*a* is wound around the first permanent magnet 18*a* and the first electro permanent magnet 20*a* and a second coil 22*b* is wound around the second permanent magnet 18*b* and the second electro permanent magnet 20*b*. The actuator 10 of the example in FIG. 2*a* comprises a first power controller 24*a* configured to apply current pulses to the first coil 22*a* and a second power controller 24*b* configured to apply current pulses to the second coil 22*b*. The first power controller 24*a* and the second power controller 24*b* are powered by a common battery 26.

The actuator 10 in FIG. 2*a* comprises a first resetting element 42*a* and a second resetting element 42*b*. In this example, each of the first resetting element 42*a* and the second resetting element 42*b* is constituted by an elastic element in the form of a spring. The first resetting element 42*a* is connected between the first base section 14*a* and the movable member 28 and the second resetting element 42*b* is connected between the second base section 14*b* and the movable member 28. The first resetting element 42*a* pushes the movable member 28 in the first direction 32 such that the second mechanical stop 40*b* engages the second base section 14, more specifically the left second pole piece 16*b* of the second base section 14*b*.

In the first position 12 of FIG. 2*a*, the first permanent magnet 18*a* and the first electro permanent magnet 20*a* have opposite polarities such that a magnetic field outside the first base section 14*a* is substantially neutral. At the same time, the second permanent magnet 18*b* and the second electro permanent magnet 20*b* are polarized in the same direction such that they combine to generate a magnetic field acting on the magnetic target section 36. This magnetic field holds the movable member 28 in the first position 12 illustrated in FIG. 2*a*.

In order to move the movable member 28 from the first position 12 in FIG. 2*a*, a current pulse of sufficient duration and level is applied to the first coil 22*a* such that a magnetic field is generated that switches the polarity of the first electro permanent magnet 20*a* from a first polarity to a second polarity but that does not switch the polarity of the first permanent magnet 18*a*, which has a higher coercivity. At the same time, a current pulse of sufficient duration and level is applied to the second coil 22*b* such that a magnetic field is generated that switches the polarity of the second electro permanent magnet 20*b* from a second polarity to a first polarity but that does not switch the polarity of the second permanent magnet 18*b*, which has higher coercivity.

Figure 2B:
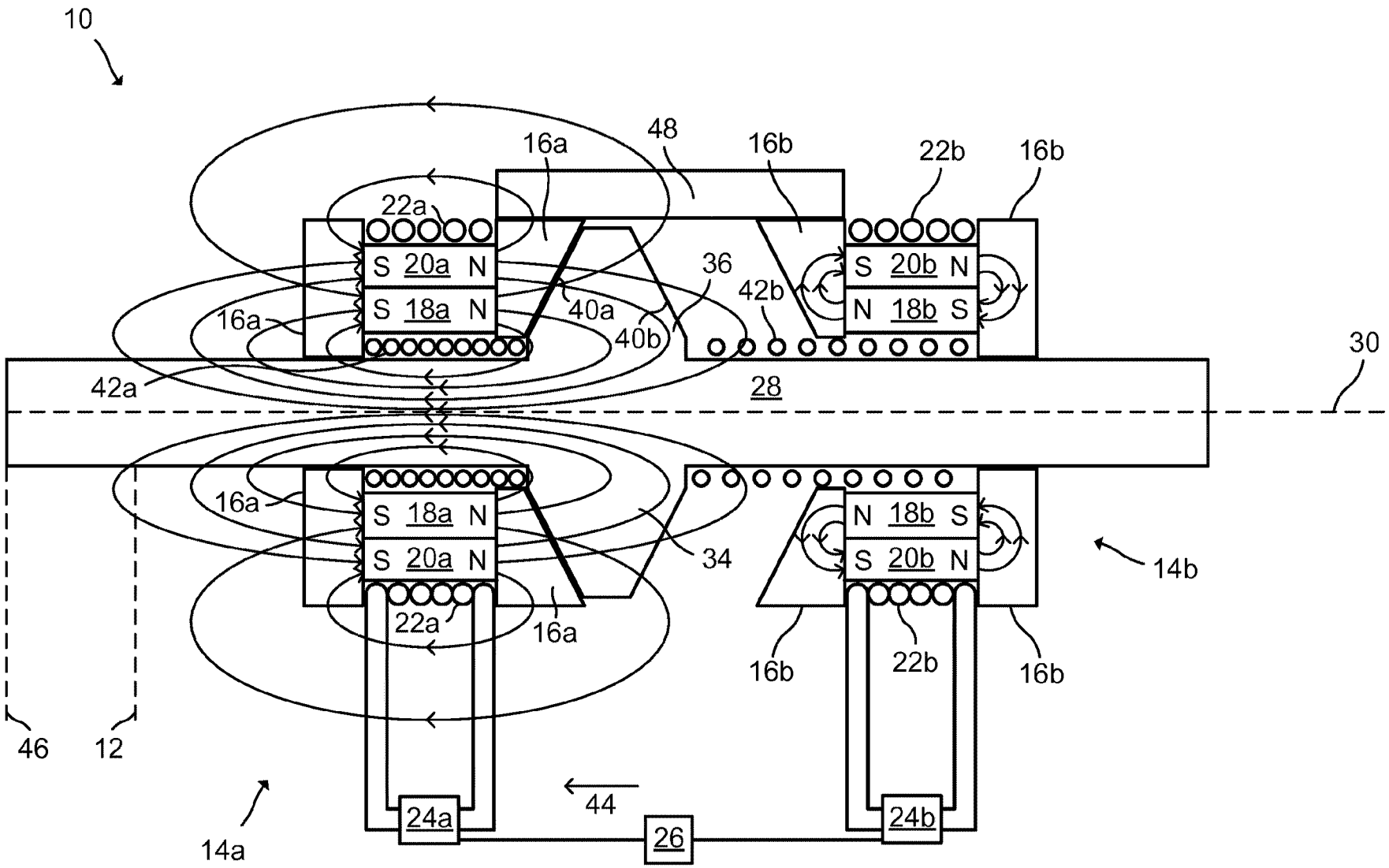
FIG. 2*b*: schematically represents a side view of the actuator in FIG. 2*a* in a second position.

FIG. 2*b* schematically represents a side view of the actuator 10 in FIG. 2*a*. As illustrated in FIG. 2*b*, when the first electro permanent magnet 20*a* has been flipped from the first polarity in FIG. 2*a* to the second polarity in FIG. 2*b*, the first permanent magnet 18 and the first electro permanent magnet 20 combine to generate a magnetic field outside the first base section 14.

At the same time, when the second electro permanent magnet 20*b* has been flipped from the second polarity in FIG. 2*a* to the first polarity in FIG. 2*b*, the second electro permanent magnet 20*b* and the second permanent magnet 18*b* are oppositely polarized such that a magnetic field outside the second base section 14*b* is substantially neutral. The magnetic field generated by the first permanent magnet 18*a* and the first electro permanent magnet 20*a* in combination acts on the magnetic target section 36 and pulls the movable member 28 in the second direction 44 linearly along the movement axis 30 to the second position 46. The movable member 28 moves within the electro permanent magnets 20*a*, 20*b*. At the same time, the first resetting element 42*a* is further compressed and the second resetting element 42*b* is slightly released until the second mechanical stop 40*b* contacts the right first pole piece 16*a* of the first base section 14*a*.

Figure 3A:
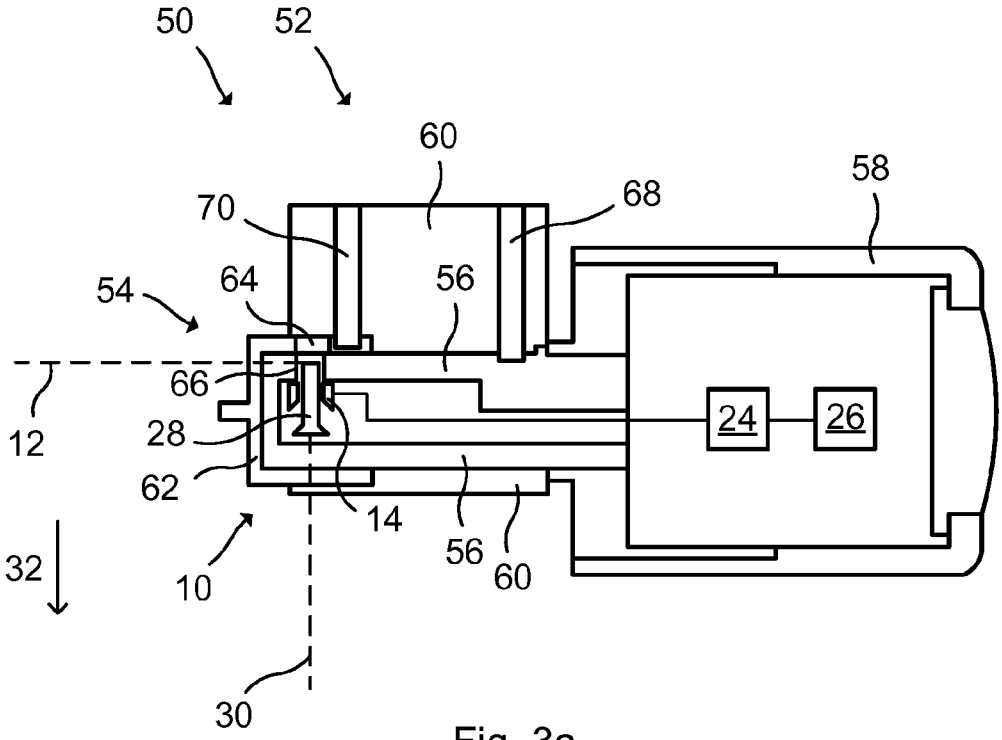
FIG. 3*a*: schematically represents a side view of a lock device comprising an actuator in a first position.

FIG. 3*a* schematically represents a side view of one example of a lock device 50 comprising an actuator 10. In FIG. 3*a*, the actuator 10 is of the type illustrated in FIGS. 1*a* and 113 but the variant in FIGS. 2*a* and 2*b*, or other variants according to the present disclosure may alternatively be employed.

The lock device 50 in FIG. 3*a* is constituted by a lock cylinder 52. The lock cylinder 52 comprises a stationary structure 54, a cylinder core 56 rotatably accommodated in the stationary structure 54 and a knob 58 connected to the cylinder core 56. In this example, the stationary structure 54 comprises a cylinder housing 60 and a tailpiece 62. A stationary radial hole 64 is provided in the cylinder housing 60 and a cylinder radial hole 66 is provided in the cylinder core 56.

The cylinder core 56 is axially fixed by means of a cylinder lock pin 68 engaging a circumferential groove on the cylinder core 56. The tailpiece 62 is axially fixed by means of a tailpiece lock pin 70 engaging a circumferential groove on the tailpiece 62.

The base section 14 and the movable member 28 of the actuator 10 are arranged within the cylinder core 56 and the power controller 24 and the battery 26 are arranged within the knob 58. In FIG. 3*a*, the movable member 28 is in the first position 12 such that the actuator 10 adopts a disconnecting position. In the disconnecting position of FIG. 3*a*, the cylinder core 56 is allowed to rotate relative to the stationary structure 54 since the movable member 28 is not protruding into the stationary radial hole 64.

Figure 3B:
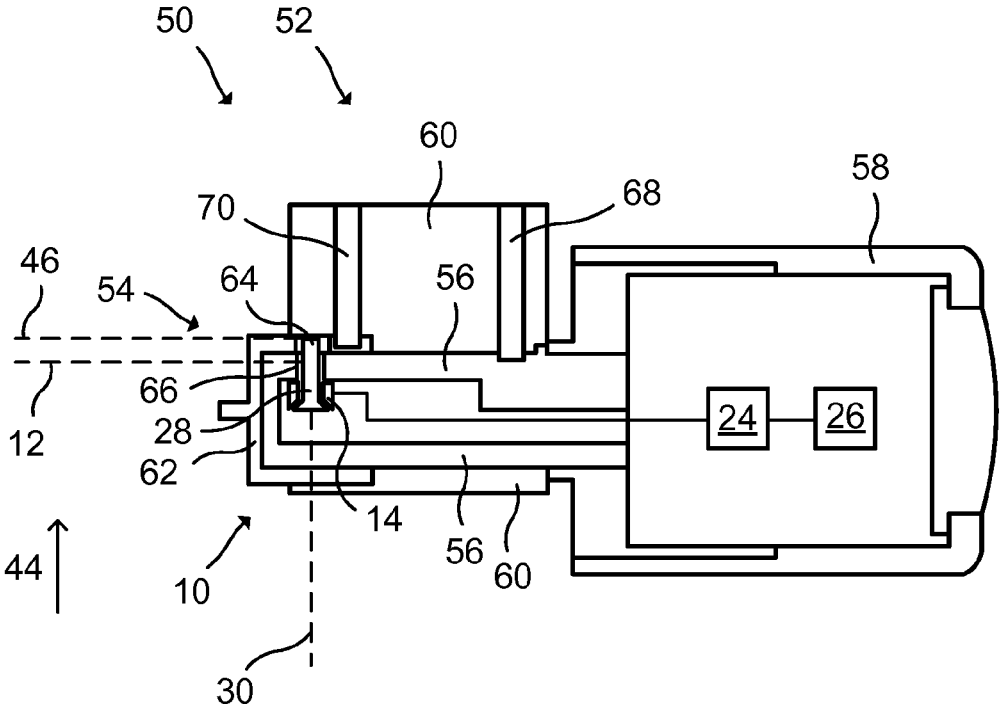
FIG. 3*b*: schematically represents a side view of the lock device in FIG. 3*a* and the actuator in a second position.

FIG. 3*b* schematically represents a side view of the lock device 50 in FIG. 3*a*. In FIG. 3*b*, the movable member 28 has moved from the first position 12 to the second position 46 such that the actuator 10 adopts an interconnecting position. In the interconnecting position of FIG. 3*b*, the movable member 28 engages both the cylinder core 56 and the stationary structure 54. The cylinder core 56 is prevented from rotating relative to the stationary structure 54 since the movable member 28 protrudes through the cylinder radial hole 66 and into the stationary radial hole 64.

Figure 4:
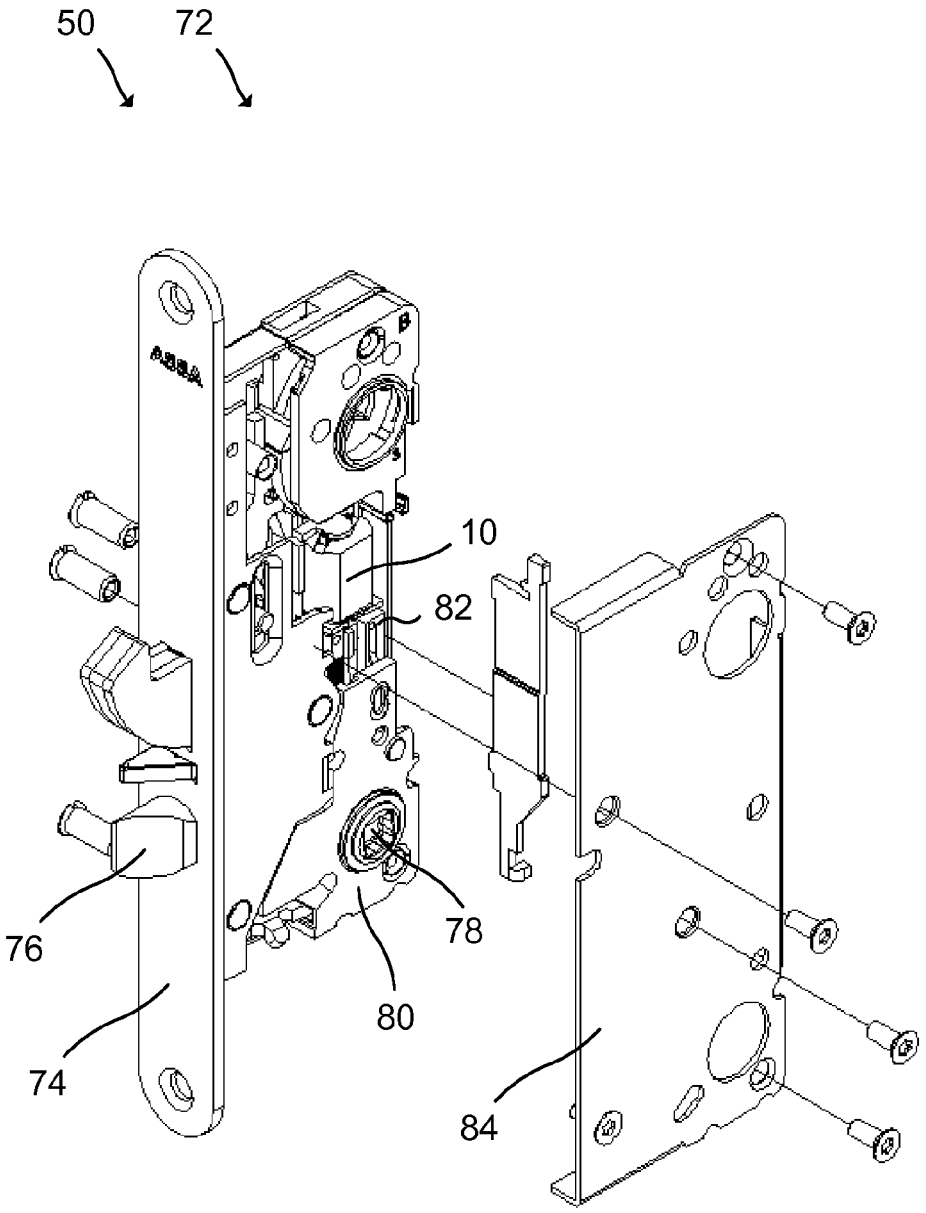
FIG. 4: schematically represents a perspective exploded view of a further lock device comprising an actuator.

FIG. 4 schematically represents a perspective exploded view of a further lock device 50 comprising an actuator 10 according to the present disclosure. The lock device 50 in FIG. 4 is constituted by a lock case 72.

The lock case 72 of the example in FIG. 4 comprises a forend 74, a latch bolt 76, a hub 78, a lever handle follower unit 80, a coupling device 82 and a cover plate 84. The hub 78 has a hub axis and is adapted to receive at least one lever handle pin. The hub 78 comprises an outer hub part rotatable about the hub axis and which is adapted to receive a first lever handle pin, and an intermediate hub part rotatable about the hub axis and coupled to a bolt in the lock device 50 for movement of the bolt between an outer and an inner end position. The coupling device 82 is movable under control of the actuator 10. By moving the actuator 10 to the first position 12, the coupling device 82 is moved to a coupling position, in which the intermediate hub part rotates together with the outer hub part. By moving the actuator 10 to the second position 46, the coupling device 82 is moved to a release position, in which the outer hub part rotates freely in relation to the intermediate hub part.

Figure 5:
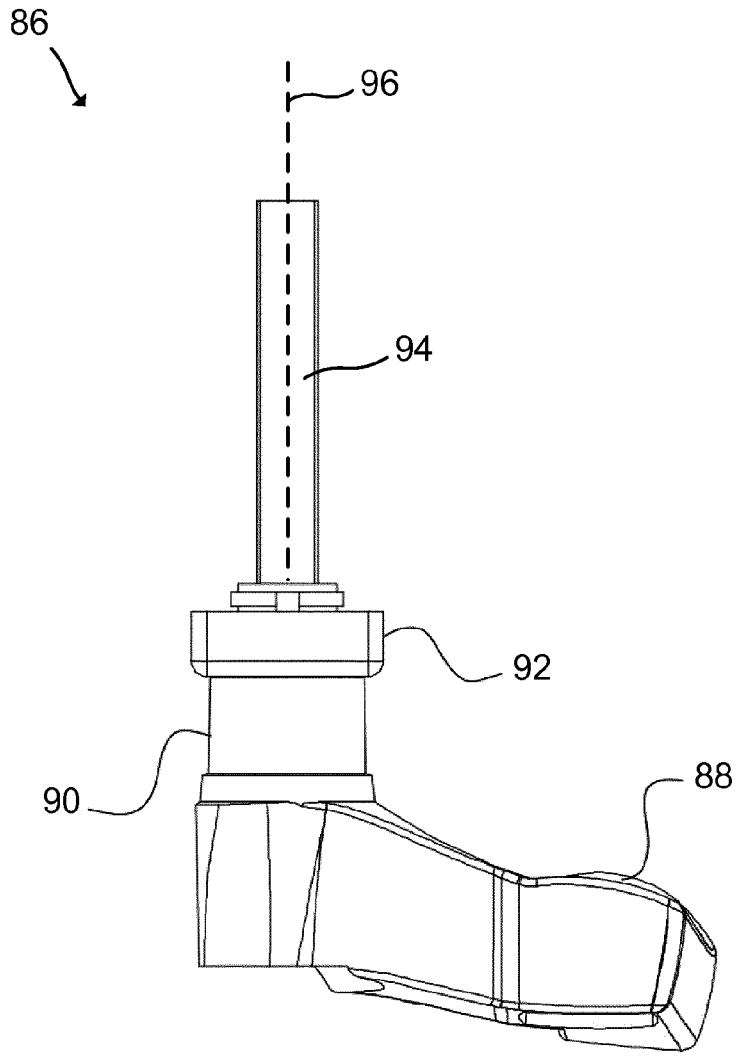
FIG. 5: schematically represents a side view of a handle device comprising an actuator.

FIG. 5 schematically represents a side view of a handle device 86 for operating doors, windows and the like, comprising an actuator (not shown) according to FIGS. 1*a* and 1*h*. The handle device 86 of this example comprises a handle grip 88, a handle neck 90, a handle escutcheon or handle plate 92 and a swivel pin or handle spindle 94 in the form of a square shank rotatable about a handle rotational axis 96.

Figure 6A:
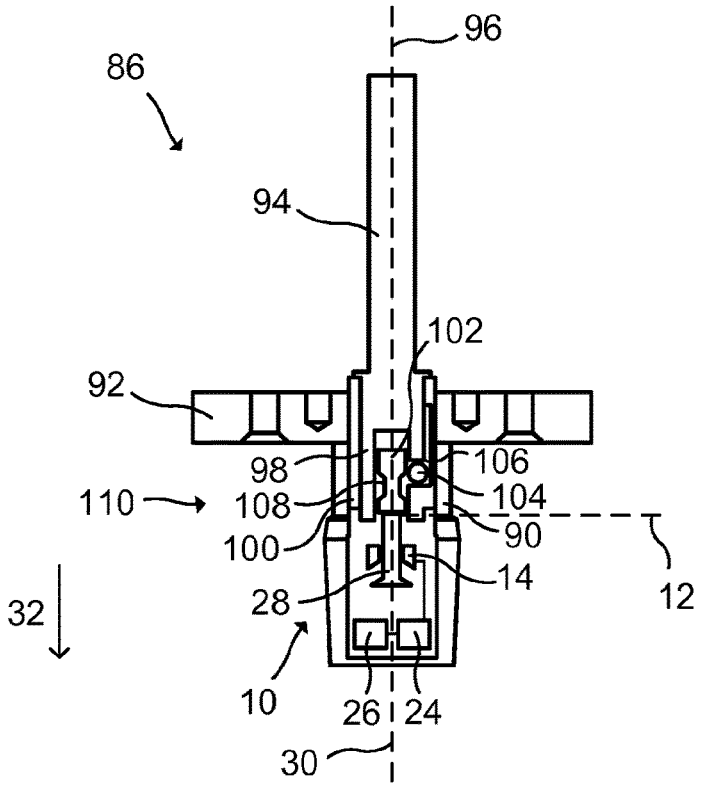
FIG. 6*a*: schematically represents a cross sectional side view of the handle device in FIG. 5 and the actuator in a first position.

FIG. 6*a* schematically represents a cross sectional side view of the handle device 86 in FIG. 5. As shown in FIG. 6*a*, the handle device 86 of this example further comprises a cylindrical end section 98 which is firmly connected to the handle spindle 94. The cylindrical end section 98 is rotatably accommodated in a boss 100, which is in turn received in the handle neck 90.

The handle device 86 of this example further comprises an activating member 102 and an engaging member 104, here implemented as a ball. The activating member 102 is movable along the handle rotational axis 96 within the cylindrical end section 98. The engaging member 104 is movable in a radial hole 106 of the cylindrical end section 98. The activating member 102 comprises a waist section 108. The activating member 102, the engaging member 104, the cylindrical end section 98 and the boss 100 form a coupling device 110.

In FIG. 6*a*, the actuator 10, which is in a first position 12, can be seen. In the first position 12, the actuator 10 has adopted the first position 12 such that the activating member 102 has been pulled to a position where the waist section 108 of the activating member 102 is not aligned with the radial hole 106 of the cylindrical end section 98. Due to this movement of the activating member 102, the engaging member 104 is pushed out from the waist section 108 to a position where the engaging member 104 protrudes radially outwards from the cylindrical end section 98 and into the boss 100. The cylindrical end section 98 and the boss 100 are thereby simultaneously engaged by the engaging member 104. In this way, the handle grip 88 is coupled to the handle spindle 94 and can therefore be used to operate a tumbler, an espagnolette bolt or some other member or device to which the handle spindle 94 is coupled. Thus, when the actuator 10 adopts the first position 12, the coupling device 110 adopts an engaging position where a first element (the boss 100) and a second element (the cylindrical end section 98) are engaged.

Figure 6B:
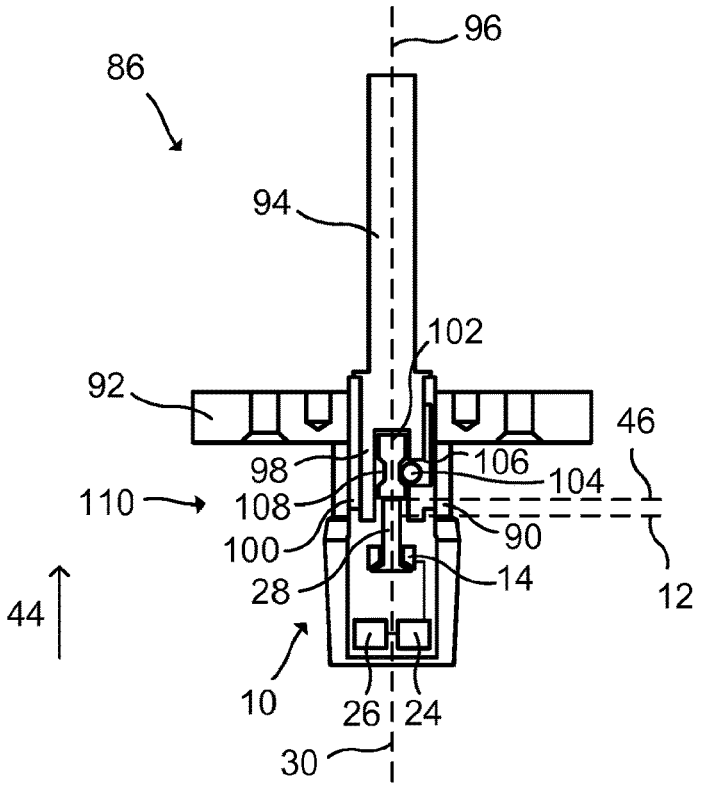
FIG. 6*b*: schematically represents a cross sectional side view of the handle device in FIGS. 5 and 6*a* and the actuator in a second position.

FIG. 6*b* schematically represents a cross sectional side view of the handle device 86 in FIGS. 5 and 6*a*. In FIG. 6*b*, the movable member 28 has pushed the activating member 102 to a position where the waist section 108 of the activating member 102 is aligned with the radial hole 106 of the cylindrical end section 98. As a consequence, the engaging member 104 is pushed into the waist section 108 of the activating member 102 such that the engaging member 104 does not protrude out from the cylindrical end section 98.

If the handle grip 88 (see FIG. 5) is rotated, the handle neck 90 and the boss too also turn. However, the rotational movement is not transmitted to the handle spindle 94 the activating member 102 and the engaging member 104.

The handle grip 88 is therefore disengaged from the handle spindle 94 such that the handle grip 88 is allowed to turn freely in relation to the handle spindle 94, thereby enabling a disengaged state of the handle device 86, a so-called free-swiveling function. In this position, it is therefore not possible, by means of the handle grip 88, to operate a tumbler, an espagnolette bolt or any other device to which the handle spindle 94 may be coupled. Thus, when the actuator to adopts the second position 46, the coupling device 110 adopts a disengaging position where the first element (the boss 100) and the second element (the cylindrical end section 98) are disengaged.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

What is claimed is:

1. Actuator comprising:

at least one base section;

at least one permanent magnet arranged in the base section;

at least one electro permanent magnet arranged in the base section, the at least one electro permanent magnet being configured to switch a polarity between a first polarity and a second polarity when being subjected to a magnetic field and configured to maintain the polarity when the magnetic field is removed;

a coil located around the electro permanent magnet;

a power controller configured to apply a current pulse to the coil to generate the magnetic field for changing the polarization of the electro permanent magnet; and a movable member comprising at least one magnetic target section, the movable member being arranged to move to a first position relative to the base section, when the electro permanent magnet adopts the first polarity, and arranged to move to a second position relative to the base section due to a magnetic field generated by the permanent magnet and the electro permanent magnet in combination and acting on the magnetic target section, when the electro permanent magnet adopts the second polarity;

wherein each of the at least one electro permanent magnet is hollow and the movable member is arranged to move within each of the at least one electro permanent magnet.

2. The actuator according to claim 1, further comprising at least one resetting element configured to move the movable member to the first position when the electro permanent magnet adopts the first polarity.

3. The actuator according to claim 2, wherein the resetting element an elastic element and wherein the actuator is configured such that the magnetic field, generated by the permanent magnet and the electro permanent magnet in combination and acting on the magnetic target section when the electro permanent magnet adopts the second polarity, moves the movable member to the second position and deforms the elastic element.

4. The actuator according to any claim 1, wherein:

the at least one base section is constituted by a first base section and a second base section;

the at least one permanent magnet is constituted by a first permanent magnet and a second permanent magnet;

the at least one electro permanent magnet is constituted by a first electro permanent magnet arranged in the first base section and a second electro permanent magnet arranged in the second base section; and the movable member is arranged to move to the first position relative to the first base section and the second base section, when the first electro permanent magnet adopts the first polarity, and arranged to move to the second position relative to the first base section and the second base section due to a magnetic field generated by the first permanent magnet and the first electro permanent magnet in combination and acting on the magnetic target section, when the first electro permanent magnet adopts the second polarity.

5. The actuator according to claim 4, wherein the movable member is arranged to move to the first position relative to the first base section and the second base section due to a magnetic field generated by the second permanent magnet end the second electro permanent magnet in combination and acting on the magnetic target section.

6. The actuator according to claim 1, further comprising a first mechanical stop defining the first position of the movable member relative to the base section.

7. The actuator according to claim 1, further comprising a second mechanical stop defining the second position of the movable member relative to the base section.

8. The actuator according to claim 1, wherein the movable member is arranged to move substantially linearly relative to the base section between the first position and the second position.

9. The actuator according to claim 1, wherein a magnetic field outside the base section is substantially neutral when the electro permanent magnet adopts the first polarity.

10. The actuator according to claim 1, wherein the permanent magnet and the electro permanent magnet are polarized in the same direction when the electro permanent magnet adopts the second polarity.

11. Lock device comprising an actuator according to claim 1.

12. The lock device according to claim 11, wherein the lock device is constituted by a lock cylinder comprising a stationary structure and a cylinder core rotatably accommodated in the stationary structure, wherein the first position of the movable member constitutes a disconnecting position in which the cylinder core is allowed to rotate relative to the stationary structure, and wherein the second position of the movable member constitutes an interconnecting position in which the movable member engages both the cylinder core and the stationary structure such that the cylinder core is prevented from rotating relative to the stationary structure.

13. The lock device according to claim 11, wherein the lock device is constituted by a lock case comprising a follower unit having a hub and a coupling device, wherein coupling device is movable under control of the actuator between an engaging position where two parts of the hub are engaged and a disengaging position where the two parts of the hub are disengaged.

14. Handle device for operating doors, windows and the like, the handle device comprising an actuator according to claim 1, a first element rotatable about an axis, a second element rotatable about the axis, a coupling device movable under control of the actuator between an engaging position where the first element and the second element are engaged and a disengaging position where the first element and the second element are disengaged.

15. Method for operating an actuator comprising at least one base section, at least one permanent magnet arranged in the base section, at least one electro permanent magnet arranged in the base section, and a movable member comprising at least one magnetic target section, wherein each of the at least one electro permanent magnet is hollow and the movable member is arranged to move within each of the at least one electro permanent magnet, the method comprising:

providing the electro permanent magnet with a first polarity such that a magnetic field outside the base section is substantially neutral;

switching the polarity of the electro permanent magnet from the first polarity to a second polarity such that the permanent magnet and the electro permanent magnet combine to generate a magnetic field acting on the magnetic target section such that the movable member moves within the electro permanent magnet from a first position relative to the base section to a second position relative to the base section.

* * * * *